US008686649B2

(12) United States Patent
Shin et al.

(10) Patent No.: US 8,686,649 B2
(45) Date of Patent: Apr. 1, 2014

(54) DEVICE FOR DRIVING LIGHT EMITTING DIODE

(71) Applicant: Silicon Works Co., Ltd., Daejeon-si (KR)

(72) Inventors: So Bong Shin, Daejeon-si (KR); Wanyuan Qu, Daejeon-si (KR); Won Ji Lee, Cheonahn-si (KR); Yong Goo Kim, Daejeon-si (KR); Ok Hwan Kwon, Daejeon-si (KR); Gyeong Sik Mun, Daejeon-si (KR); Young Suk Son, Daejeon-si (KR)

(73) Assignee: Silicon Works Co., Ltd., Daejeon-Si (KR)

( * ) Notice: Subject to any disclaimer, the term of this patent is extended or adjusted under 35 U.S.C. 154(b) by 0 days.

(21) Appl. No.: 13/661,241

(22) Filed: Oct. 26, 2012

(65) Prior Publication Data

US 2013/0106296 A1 May 2, 2013

(30) Foreign Application Priority Data

Oct. 27, 2011 (KR) ..... 10-2011-0110326

(51) Int. Cl.
*H05B 37/02* (2006.01)

(52) U.S. Cl.
USPC ..... 315/185 R; 315/123; 315/307

(58) Field of Classification Search
USPC ..... 315/123, 185 R, 200 R, 291, 294, 307
See application file for complete search history.

(56) References Cited

U.S. PATENT DOCUMENTS

| | | | | |
|---|---|---|---|---|
| 7,009,580 | B2 * | 3/2006 | Leung | 345/46 |
| 8,207,685 | B2 * | 6/2012 | Cheng et al. | 315/306 |
| 8,471,481 | B2 * | 6/2013 | Shin et al. | 315/185 R |
| 8,569,956 | B2 * | 10/2013 | Shteynberg et al. | 315/123 |
| 2010/0308738 | A1 * | 12/2010 | Shteynberg et al. | 315/185 R |
| 2011/0084618 | A1 * | 4/2011 | Kang et al. | 315/185 R |
| 2011/0084619 | A1 * | 4/2011 | Gray et al. | 315/185 R |
| 2013/0278153 | A1 * | 10/2013 | Pi | 315/185 R |

FOREIGN PATENT DOCUMENTS

| | | |
|---|---|---|
| JP | 2008-077892 | 4/2008 |
| KR | 10-0997050 | 11/2010 |
| KR | 10-1064906 | 9/2011 |

* cited by examiner

*Primary Examiner* — Don Le
(74) *Attorney, Agent, or Firm* — Kile Park Reed & Houtteman PLLC

(57) ABSTRACT

The present invention introduces a device and a method for driving an LED with an improved power factor without using a voltage detector having a large amount of area and power consumption. The device for driving an LED includes a power supply unit, an LED array, and a current path select circuit. The LED array 320 is connected with the power supply unit in parallel and includes at least one LED string including LED channels LED1 to LEDn that are configured of a plurality of LEDs connected in series. The current path select circuit selects a path of current flowing from output terminals of the plurality of LED channels according to voltage levels of each of the output terminals of the plurality of LED channels.

9 Claims, 3 Drawing Sheets

DEVICE FOR DRIVING LIGHT EMITTING DIODE

BACKGROUND OF THE INVENTION

1. Field of the Invention

The present invention relates to a driving device and a driving method for supplying power to an LED.

2. Description of the Related Art

FIG. 1 is a circuit diagram of a device for driving an LED in accordance with the related art.

Referring to FIG. 1, a device 100 for driving an LED includes a power supply $V_s$, a current switching circuit 10, a voltage detector 20, and a rectifying circuit 30.

The power supply $V_s$ is an AC power supply having a predetermined frequency and the rectifying circuit 30 rectifies AC that is output from the power supply $V_s$. The current switching circuit 10 includes a plurality of light emitting diodes (hereinafter, referred to as LED; $D_1$ to $D_k$, k is a natural number) that are connected in series and a plurality of current sources $I_1$ to $I_k$ that determine a path of current flowing from output terminals of each LED. The voltage detector 20 monitors a voltage level output from the rectifying circuit 30 and operates one selected from a plurality of current sources $I_1$ to $I_k$ according to the monitored voltage level.

When the voltage output from the rectifying circuit 30 has a voltage level enough to turn on a first LED $D_1$, the voltage detector 20 selects and operates only the first current source $I_1$. In this case, current $I_{LED1}$ passing through the power supply $V_s$ and the rectifying circuit 30 flows into a ground GND via the first LED $D_1$ and the first current source $I_1$.

Next, when the voltage output from the rectifying circuit 30 rises to a voltage level enough to turn on both of the first LED $D_1$ and the second LED $D_2$, the voltage detector stops an operation of the first current source $I_1$ and selects and operates only the second current source $I_2$. In this case, the current $I_{LED1}$ passing through the power supply $V_s$ and the rectifying circuit 30 flows into the ground GND via the first LED $D_1$, the second LED $D_2$ and the second current source $I_2$.

Next, when the voltage output from the rectifying circuit 30 rises to voltage level enough to turn on all of the plurality of LEDs $D_1$ to $D_k$, only the k-th current source $I_k$ is normally operated and an operation of the remaining current sources $I_1$ to $I_{(k-1)}$ stops. In this case, the current $I_{LED1}$ passing through the power supply $V_s$ and the rectifying circuit 30 flows into the ground GND via the first LED $D_1$, the second LED $D_2$ to the k-th LED $D_k$, and the k-th current source $I_k$.

On the contrary, when the voltage output from the rectifying circuit 30 is decreased, the current source and the LED are turned off in an opposite direction to the foregoing direction.

In case of the LED driving circuit illustrated in FIG. 1 in accordance with the related art, the voltage detector 20 directly detecting the voltage level output from the rectifying circuit 30 is needed, wherein the voltage detector 20 may be implemented by various schemes, but in all cases, may have a problem in that the area and power consumed by the driving device 100 may be large enough not to be able to be ignored.

FIG. 2 illustrates operation characteristics of a device for driving an LED in accordance with the related art.

Referring to FIG. 2, when voltage Vac supplied to the LED strings $D_1$ to $D_k$ configuring the current switching circuit 10 is increased or decreased in a parabola form due to the rectification of power $V_s$, voltage $V_{LED1}$ dropping at the LED strings $D_1$ to $D_k$ configuring the current switching circuit 10 is also increased or decreased according to a change in voltage level of the rectified voltage Vac.

However, even though the voltage Vac supplied to the LED strings $D_1$ to $D_k$ configuring the current switching circuit 10 is increased or decreased in a parabola form due to the rectification of power $V_s$, a magnitude in the current flowing into the LED strings $D_1$ to $D_k$ configuring the current switching circuit 10 is limited. The reason is that an electrical characteristic, that is, a current amount of the plurality of current sources $I_1$ to $I_k$ configuring the device 100 for driving an LED in accordance with the related art is the same.

For this reason, there is a problem in that a power factor of the device for driving an LED in accordance with the related art is low.

As illustrated in FIG. 2, 1Vth means threshold voltage that may turn on the first LED $D_1$ and 2Vth means threshold voltage that may turn on both of the first LED $D_1$ and the second LED $D_2$. Therefore, 5Vth means threshold voltage that may turn on all of the five LEDs that are connected in series.

FIG. 2 illustrates operation characteristics of a case in which all of the five LEDs are connected in series, for convenience of explanation.

SUMMARY OF THE INVENTION

Accordingly, the present invention has been made in an effort to solve the problems occurring in the related art, and an object of the present invention is to provide a device for driving an LED with an improved power factor without a voltage detector consuming a large amount of area and power.

Another object of the present invention is to provide a method for driving an LED with an improved power factor without a voltage detector consuming a large amount of area and power.

In order to achieve the above object, according to one aspect of the present invention, a device for driving an LED in accordance with an embodiment of the present invention includes a power supply unit, an LED array, and a current path select circuit. The LED array is connected with the power supply unit in parallel and includes at least one LED string including LED channels LED1 to LEDn that are configured of a plurality of LEDs connected in series. The current path select circuit selects a path of current flowing from output terminals of the plurality of LED channels according to voltage levels of each of the output terminals of the plurality of LED channels.

In order to achieve the above object, according to another aspect of the present invention, a method for driving an LED in accordance with an embodiment of the present invention relates a method for driving a device for driving an LED in accordance with the embodiment of the present invention and includes initializing a current source and selecting a current source. In the initializing of the current source, all of the plurality of current sources each connected between output terminals of a plurality of LED channels and a ground are normally operated. In the selecting of the current source, when a succeeding LED channel connected with the output terminal of any preceding LED channel among the LED channels connected in series is turned on, an operation of the current source commonly connected with the output terminal of the preceding LED channel and the input terminal of the succeeding LED channel stops.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
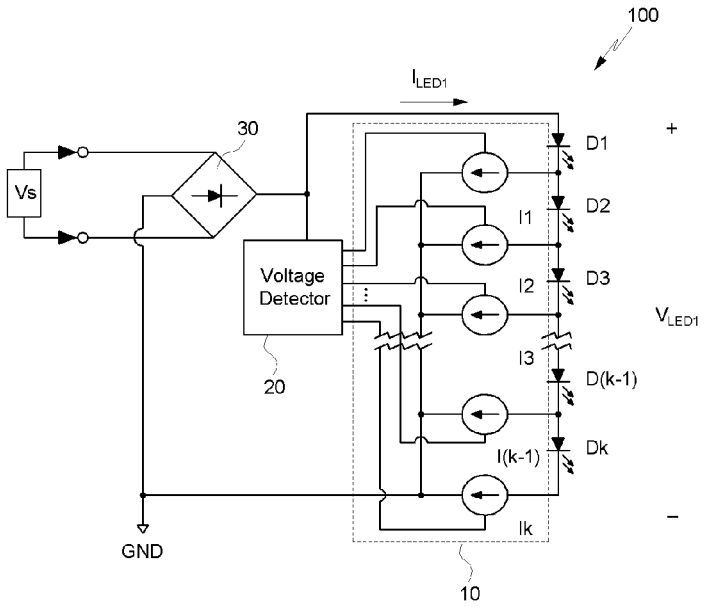
Fig.1 (Prior Art)
FIG. 1 is a circuit diagram of a device for driving an LED in accordance with the related art.

Reference will now be made in greater detail to a preferred embodiment of the invention, an example of which is illustrated in the accompanying drawings. Wherever possible, the same reference numerals will be used throughout the drawings and the description to refer to the same or like parts.

Hereinafter, exemplary embodiments of present invention will be described in detail with reference to the accompanying drawings. Like components are denoted by like reference numerals proposed in each drawing.

Figure 3:
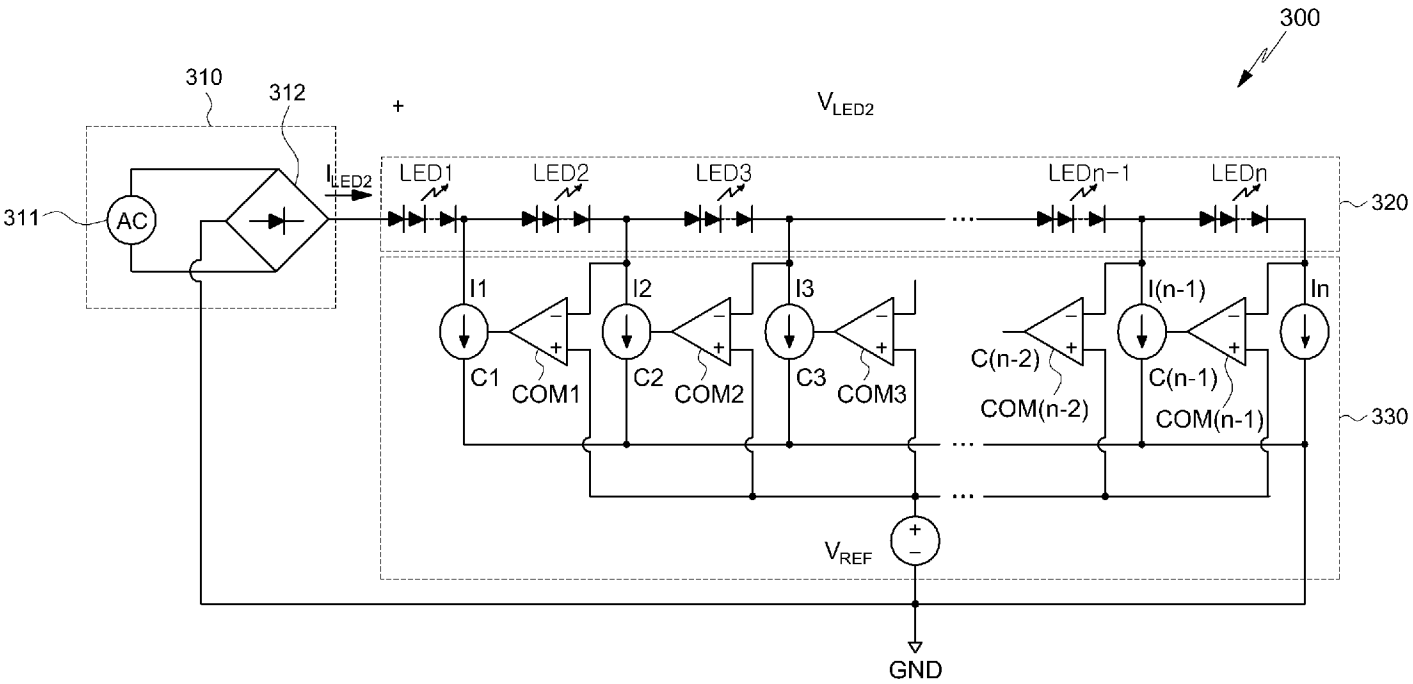
FIG. 3 is a circuit diagram of a device for driving an LED in accordance with an embodiment of the present invention.

FIG. 3 is a circuit diagram of a device for driving an LED in accordance with an embodiment of the present invention.

Referring to FIG. 3, a device 300 for driving an LED in accordance with an embodiment of the present invention is configured to include a power supply unit 310, an LED array 320, and a current path select circuit 330.

The power supply unit 310 includes a power supply 311 and a rectifying circuit 312. The power supply 311 means an AC voltage source. In the rectifying circuit 312, a terminal having a positive voltage level by rectifying voltage of a power supply 311 that is an AC voltage source is connected with an input terminal of a first LED channel LED1 of an LED array 320 and a terminal having a negative voltage level or a zero (0) voltage level is connected with an output terminal of an n-th LED channel LEDn, which is represented by a ground GND for convenience of explanation.

The LED array 320 is connected with the power supply unit 310 and includes an LED string including LED channels LED1 to LEDn that are configured of a plurality of LEDs connected in series. Even though FIG. 3 illustrates only a single string, in an actual case, a structure in a plurality of strings are connected in parallel can be implemented.

The current path select circuit 330 selects paths of current flowing from each of the output terminals of the LED channels LED1 to LEDn−1 according to voltage levels of each of the output terminals of the LED channels LED1 to LEDn. The current path select circuit 330 for performing the above function includes a plurality of current sources $I_1$ to In that cuts off a flow of current flowing from each of the output terminals of the LED channels LED1 to LEDn−1 according to the voltage levels of each of the output terminals of the LED channels LED1 to LEDn−1 and a plurality of control signal generators COM1 to COM (n−1) that each generates control signals C1 to C (n−1) that determine an operation of the current sources $I_1$ to In−1. Here, n is multiple natural numbers.

The first current source $I_1$ provides a path of current flowing into the ground GND from the output terminal of the first LED channel LED1, in response to the first control signal C1 and controls the current flow. The second current source $I_2$ provides a path of current flowing into the ground from the output terminal of the second LED channel LED2 in response to the second control signal C2 and controls a current flow so that the increased current more than the first current source $I_1$ may flow. Generalizing this, when n is a natural number, the $n-1^{th}$ current source In−1 provides a path of current flowing into a ground from an output terminal of the n-th LED channel LEDn in response to the $n-1^{th}$ control signal Cn−1 and controls the current flow. The present embodiment illustrates that the current source cuts off the flow of current by being turned off when the control signal is activated, but the present invention is not limited thereto. For example, the current source may also be configured to cut off the flow of current by being turned off when the control signal is not activated.

The first control signal generator COM1 compares the voltage level of the output terminal of the second LED channel LED2 with a predetermined reference voltage $V_{REF}$ to generate the first control signal C1. The second control signal generator COM2 compares the voltage level of the output terminal of the third LED channel LED3 with the reference voltage $V_{REF}$ to generate the second control signal C2. Generalizing this, the n−1-th control signal generator COM (n−1) compares the voltage level of the output terminal of the n-th LED channel LEDn with the reference voltage $V_{REF}$ to generate the n−1-th control signal C (n−1).

The embodiment of the present invention is proposed to vary a current amount flowing into each of the plurality of current sources $I_1$ to In so as to improve a power factor. That is, the current amount that can flow into the current sources is increased as the current sources are connected with the output terminal of the LED channel far away from the power supply unit 310.

Here, each of the plurality of control signal generators COM1 to COM (n−1) may be implemented by comparators of which input terminals (−) are connected with the output terminals of the corresponding LED channels and the other input terminals (+) are connected with the reference voltage $V_{REF}$ to generate the corresponding control signals C1 to C (n−1) to the output terminals.

A method for applying the reference voltage $V_{REF}$ from the outside of an LED driving device 300 is also possible, but an embodiment of applying the reference voltage $V_{REF}$ by further including a reference voltage source is also possible. A predetermined deviation is present even in the electrical characteristics generated under the same condition and therefore, the voltage level of the reference voltage $V_{REF}$ may be determined according to the electrical characteristics of the used LED channel.

Hereinafter, an operation of the device 300 for driving an LED in accordance with the embodiment of the present invention will be described.

First, all of the plurality of current sources $I_1$ to In is initially turned on so as to be set in a state in which current can flow. This is to operate the device 300 for driving an LED in accordance with the embodiment of the present invention. The present embodiment illustrates the case in which the voltage level of voltage $V_{AC}$ output from the power supply unit 310 is voltage rising or falling with a predetermined tendency, for example, voltage rectifying AC voltage.

When the voltage level of the voltage $V_{AC}$ output from the power supply unit 310 may turn on the first LED channel LED1, but may not turn on the second LED channel LED2, the first LED channel LED1 is turned on. In this case, the first current source $I_1$ is in the state in which current may flow and therefore, the current $I_{LED2}$ passing through the power supply 311 and the rectifying circuit 312 flows into the ground GND via the first LED channel LED1 and the first current source $I_1$. In this case, even though the remaining current sources $I_2$ to In are in the state in which current may flow, the LED channels LED2 to LEDn each connected with the current sources $I_2$ to In are in a turned of state and therefore, no current flowing into the ground GND via the remaining current sources $I_2$ to In is.

Next, when the voltage level of the voltage $V_{AC}$ output from the power supply unit 310 may turn on the first LED channel LED1 and the second LED channel LED2, but may not turn on the third LED channel LED3, the first LED channel LED1 and the second LED channel LED2 are simultaneously turned on. The voltage level of the output terminal of the second LED channel LED2 rises at an instant that the second LED channel LED2 is turned on. In this case, the first control signal generator COM1 activates the first control signal C1 using the voltage level of the output terminal of the second LED channel LED2 and the reference voltage $V_{REF}$ when the voltage level of the output terminal of the second LED channel LED2 is fluctuated. The activated first control signal C1 turns off the first current source $I_1$ to stop the flow of current and therefore, the current $I_{LED2}$ passing through the power supply 311 and the rectifying circuit 312 flows into the ground GND via the first LED channel LED1, the second LED channel LED2, and the second current source $I_2$.

In the device 300 for driving an LED in accordance with the embodiment of the present invention, the current source connected with the output terminal of any preceding LED channel among the plurality of LED channels connected in series stops the flow of current by being turned off when the succeeding LED channel is turned on and the current source connected with the output terminal of the succeeding LED channel flows current into the ground by forming the current path together with the preceding LED channel and the succeeding LED channel. The current source connected with the output terminal of the succeeding LED channel is controlled to move a larger amount of current than the current source connected with the output terminal of the preceding LED channel. Therefore, the current amount may be sequentially increased corresponding to the increase in the magnitude in the supply voltage $V_{AC}$ enough to turn on the preceding LED channel and the succeeding LED channel.

The plurality of LED channels connected in series is sequentially turned on according to the increase in the voltage level of the rectifying voltage $V_{AC}$. On the contrary, when the voltage level of the voltage $V_{AC}$ is decreased, the LED channel may be turned off in a reverse order to an order of turning on the plurality of LED channels.

Figure 4:
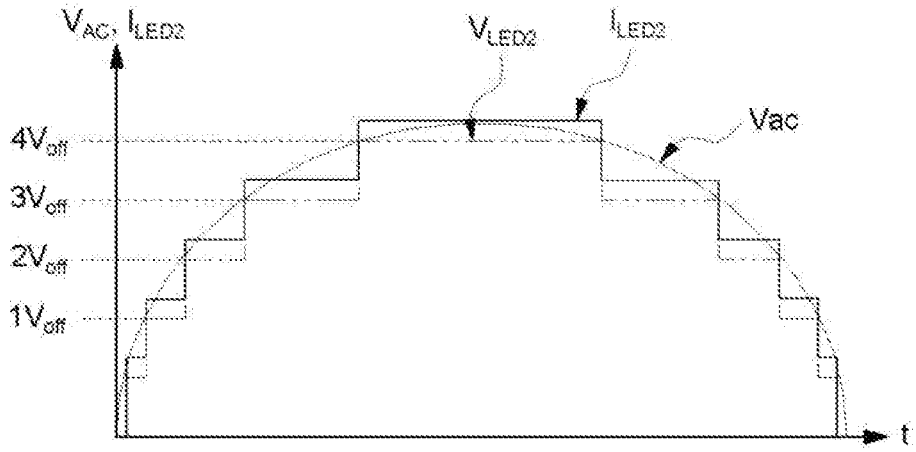
FIG. 4 illustrates operation characteristics of a device for driving an LED in accordance with the related art.

FIG. 4 illustrates operation characteristics of a device for driving an LED in accordance with the related art.

Referring to FIG. 4, when the rectified voltage $V_{AC}$ supplied to the LED channels LED1 to LEDn is increased or decreased in a parabola form, the voltage $V_{LED2}$ dropping at the plurality of LED channels LED1 to LEDn connected in series is also increased or decreased according to a change in the voltage level of the rectified voltage $V_{AC}$. Similarly, the magnitude in the current $I_{LED2}$ flowing into the plurality of LED channels LED1 to LEDn connected in series is increased or decreased according to the change in the voltage level of the rectified voltage $V_{AC}$.

The reason is that the current driving capability of the plurality of current sources $I_1$ to In in accordance with the embodiment of the present invention is increased as the current sources are far way from the power supply unit 310. On the other hand, the device 100 for driving an LED illustrated in FIG. 1 uses a predetermined current level of current source and therefore, the current driving capability is constantly maintained regardless of the change in the magnitude of the rectified voltage. Therefore, it can be appreciated that the device 300 for driving an LED in accordance with the embodiment of the present invention does not use an inductor and a capacitor so as to improve an additional power factor according to the change together with the current driving capability corresponding to the change in the magnitude of the rectified voltage other than the effect of the device 100 for driving an LED in accordance with the related art for improving the power factor.

Figure 2:
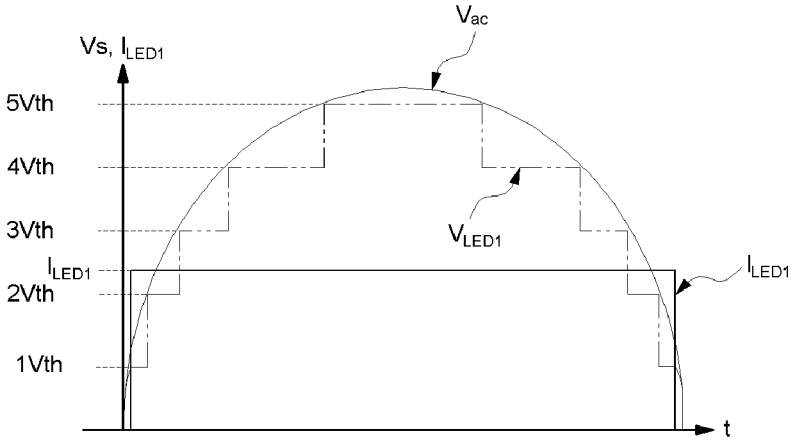
Fig.2 (Prior Art)
FIG. 2 illustrates operation characteristics of a device for driving an LED in accordance with the related art.

Here, $1V_{off}$ means the voltage of the output terminal of the second LED channel LED2 at the instant that the operation of the first current source $I_1$ stops and $2V_{off}$ means the voltage of the output terminal of the third LED channel LED3 at the instant that the operation of the second current source $I_2$ stops. In order to compare with an example illustrated in FIG. 2, FIG. 4 illustrates the operation characteristics of the case in which all of the five LED channels are connected in series.

Further, unlike the device for driving an LED operated by the LED turn on voltage preset in the voltage detector in accordance with the related art, the device for driving an LED in accordance with the embodiment of the present invention is operated by directly detecting the output voltage of the LED channel turning off the current source and therefore, may be operated without being affected by the deviation in the turn on voltage of the LED channel and the number of LED channels.

The method for driving an LED among the technical problem to be solved by the present invention may be induced from the description of the operation of the device 300 for driving an LED, but will again be described below.

The method for driving an LED in accordance with the embodiment of the present invention includes initializing the current source, improving the power factor, and selecting the current source.

In the initializing of the current source, all of the current sources $I_1$ to In each connected between the output terminals of the LED channels LED1 to LEDn and the ground GND are operated in the state in which current may flow. In the improving of the power factor, the current amount flowing into each of the current sources $I_1$ to In each connected between the output terminals of the LED channels LED1 to LEDn and the ground GND is relatively increased as the current sources are far away from the power supply unit 310. In the selecting of the current source, when the succeeding LED channel connected with the output terminal of any preceding LED channel among the LED channels LED1 to LEDn connected in series is turned on, the operation of the current source commonly connected with the output terminal of the preceding LED channel and the input terminal of the succeeding LED channel stops.

A method for driving an LED in accordance with another embodiment of the present invention may further include setting reference voltage $V_{REF}$. In this case, in the selecting of the current source, it is determined whether the succeeding LED channel is turned on by comparing the voltage level of the output terminal of the preceding LED channel with the reference voltage $V_{REF}$.

As is apparent from the above description, the present invention provides the device for driving an LED capable of driving the LED using the simple and new algorithm to increase the power factor and improve the power efficiency, while decreasing the power consumption and the area of the driving device in the overall system.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A device for driving an LED, comprising:

a plurality of LED channels configured to be connected with a power supply unit, include at least one LED, and connected in series; and a current path select circuit configured to select a path of current flowing from an output terminal of the LED channel according to voltage levels of each of the output terminals of the plurality of LED channels, wherein the current path select circuit includes:

a first current source configured to control current flowing into a ground from an output terminal of a first LED channel LED1 of which the input terminal is connected with the power supply unit, in response to a first control signal;

a second current source configured to control current flowing into a ground from an output terminal of a second LED channel LED2 of which the input terminal is connected with the output terminal of the first LED channel LED1, in response to a second control signal;

an n−1-th current source configured to control current flowing into the ground from an output terminal of an n−1-th LED channel LEDn−1 of which the input terminal is connected with an output terminal of an n−2-th LED channel LEDn−2, in response to an n−1-th (n is a natural number of 4 or more) control signal;

an n-th current source configured to provide a path of current flowing into the ground from an output terminal of an n-th LED channel LEDn of which the LEDn is connected with the output terminal of the n−1-th LED channel LEDn−1;

a first control signal generator configured to compare a voltage level of the output terminal of the second LED channel LED2 with a predetermined reference voltage to generate the first control signal;

a second control signal generator configured to compare a voltage level of an output terminal of the third LED channel LED3 with the reference voltage to generate the second control signal; and an n−1-th control signal generator configured to compare the voltage level of the output terminal of the n-th LED channel LEDn with the reference voltage to generate the n−1-th control signal.

2. The device of claim 1, wherein a current amount flowing into each of the plurality of current sources is relatively increased as the current sources are connected with the output terminals of the LED channels far away from the power supply unit.

3. The device of claim 1, wherein the control signal generators each are comparators of which input terminals are connected with the output terminals of the corresponding LED channels and the other input terminals are connected with reference voltage to generate the corresponding control signal to output terminals.

4. The device of claim 3, wherein the current path select circuit further includes a reference voltage source configured to supply the reference voltage to the plurality of comparators, respectively.

5. The device of claim 1, wherein the power supply unit includes:

an AC power supply; and a rectifying circuit configured to rectify voltage having a sinusoidal wave form output from the AC power supply and supply the rectified voltage to the plurality of LED channels.

6. A device for driving n LED channels (n is multiple natural numbers) configured to include at least one LED, and connected in series, the device comprising:

LED channels configured to include at least one LED, and connected in series; and n current sources of which the terminals are connected with output terminals of each LED channel corresponding to each LED channel and the other terminals are connected with a ground to cut off a flow of current flowing into the ground from each LED channel in response to the control signals; and n−1 comparators comparing an output voltage of an n-th LED channel with reference voltage to activate the control signals when the output voltage of the n-th LED channel is larger than the reference voltage and provide the activated control signal to the n−1-th current source.

7. The device of claim 6, further comprising:

a reference voltage source configured to provide the reference voltage.

8. The device of claim 6, wherein voltage applied to each LED channel is voltage obtained by rectifying AC voltage.

9. The device of claim 6, wherein an n-th current source is supplied with current larger than the n−1-th current source.

* * * * *